US008623270B2

(12) United States Patent
Waitlevertch et al.

(10) Patent No.: US 8,623,270 B2
(45) Date of Patent: Jan. 7, 2014

(54) DUAL OUTLET INJECTION SYSTEM

(75) Inventors: Joseph R. Waitlevertch, Butler, PA (US); Larry J. Epps, Butler, PA (US); Michael S. Ross, Spencer, OH (US)

(73) Assignee: ESM Group Inc., Amherst, NY (US)

( * ) Notice: Subject to any disclaimer, the term of this patent is extended or adjusted under 35 U.S.C. 154(b) by 188 days.

(21) Appl. No.: 13/001,497

(22) PCT Filed: Jun. 30, 2009

(86) PCT No.: PCT/US2009/049172

§ 371 (c)(1),
(2), (4) Date: Mar. 22, 2011

(87) PCT Pub. No.: WO2010/002838

PCT Pub. Date: Jan. 7, 2010

(65) Prior Publication Data

US 2011/0167963 A1 Jul. 14, 2011

Related U.S. Application Data

(60) Provisional application No. 61/078,076, filed on Jul. 3, 2008.

(51) Int. Cl.
*C21C 5/48* (2006.01)

(52) U.S. Cl.
USPC ..... 266/216; 266/265

(58) Field of Classification Search
USPC ..... 266/216, 96, 176, 226, 265
See application file for complete search history.

(56) References Cited

U.S. PATENT DOCUMENTS

| | | | | |
|---|---|---|---|---|
| 5,188,661 | A | 2/1993 | Cook et al. | |
| 6,010,658 | A | 1/2000 | Ross et al. | |
| 2005/0127581 | A1 | 6/2005 | Leigh | |
| 2007/0090132 | A1 | 4/2007 | Williams et al. | |
| 2011/0167963 | A1 * | 7/2011 | Waitlevertch et al. | 75/568 |

OTHER PUBLICATIONS

WIPO, International Search Report mailed Aug. 19, 2009 in International Application No. PCT/US09/49172.

WIPO, International Preliminary Report on Patentability issued Jan. 5, 2011 in International Application No. PCT/US09/49172.

* cited by examiner

*Primary Examiner* — Scott Kastler
(74) *Attorney, Agent, or Firm* — Hodgson Russ LLP

(57) ABSTRACT

A dual outlet injector is disclosed for use in a dual lance or dual port desulfurization station, whereby reagent from a given injector vessel may be injected into two separate supply pipes respectively corresponding to the dual lances or dual ports. The dual outlet injector enables a desulfurization station to be configured comprising only one supply vessel for powdered magnesium reagent and only one supply vessel for a carrier reagent such as powdered lime.

32 Claims, 4 Drawing Sheets

DUAL OUTLET INJECTION SYSTEM

CROSS-REFERENCE TO RELATED APPLICATIONS

The present application claims priority of U.S. provisional application No. 61/078,076 filed Jul. 3, 2008, which provisional application is incorporated herein by reference in its entirety.

FIELD OF THE INVENTION

The present invention relates generally to metal making equipment and processes, and more particularly to an apparatus, system, and method applicable to desulfurization stations for injecting desulfurization reagents into transfer ladles of molten metal.

BACKGROUND OF THE INVENTION

It is common when making steel to take molten iron from a blast furnace, subject it to desulfurization, introduce it into a basic oxygen furnace to remove carbon, and to then continuously cast the resultant liquid product. In desulfurization pretreatment, a lance is lowered into the molten iron in the transfer ladle and a controlled amount of powdered reagents consisting typically of magnesium, lime and calcium carbide is injected through the lance into the molten iron. Sulfur impurities are thereby reacted into insoluble sulfides that collect in the slag which can then be raked off. As a practical matter, it is desired to complete the desulfurization process without undue delay, in order not to interrupt downstream processing. If there is an interruption in flow or plugging of materials and the ribbon of continuous cast material becomes broken, significant costs are involved to restart the ribbon. Therefore, it is essential that desulfurization continue without significant interruption. To help ensure uninterrupted desulfurization, dual port lances such as that described in U.S. Pat. No. 5,188,661 were introduced, followed by dual lance desulfurization stations, as described for example in U.S. Pat. No. 6,010,658. In state of the art desulfurization stations, a mixture of powdered magnesium and a carrier reagent, like for example powdered lime and/or calcium carbide, is injected through each of a pair of lances of a dual lance station, or through each port of a dual port lance, into the molten iron.

The powdered reagents are initially stored in separate "injectors" each including a pressurized storage vessel and a single outlet orifice (co-injection). Alternatively, depending on the metallurgical treatment requirements of some applications, it is not required to use separate "injectors" but instead a single injector (mono-injection) is used that injects a suitable reagent containing the components required for that particular treatment application. For yet other metallurgical treatment requirements of some applications, it is required to use a combination of separate "injectors" and single injectors (multiple-injection) to be able to inject the desired combination of reagents for the given application.

For the sake of clarity the following disclosures do concentrate on the co-injection process of lime reagent and magnesium reagent but it shall be understood that the same principles shall apply to the other injection processes and suitable reagents as well. Flow of powdered reagent through the injector outlet orifice may be governed by a variable orifice valve of the type disclosed in U.S. Pat. No. 5,108,075, or by a fixed orifice valve. If a fixed orifice valve is used, flow rates may be varied by varying the pressure in the vessel, or by changing the orifice. A shut-off valve is also provided upstream of the orifice valve for selectively stopping flow through the orifice valve, thereby allowing for maintenance of the orifice valve.

Initially, an inert gas under pressure, which is typically referred to as transport gas, will be introduced into a tube below the outlet orifice of the lime injector to initiate flow of the lime reagent. The transport gas will then flow to a location below the outlet orifice of the magnesium injector, so the powdered lime can pick up the magnesium reagent and transport it to a lance.

FIG. 1 is a schematic diagram of a dual-lance desulfurization station 10 of the prior art. Station 10 includes a first magnesium injector 2 having a magnesium supply vessel 12 and a first lime injector 4 having a lime supply vessel 14, each injector 2, 4 feeding material into a first supply pipe 16 through respective outlet orifices 18 and 20. First supply pipe 16 carries material, with the help of an inert pressurized transport gas, to a first lance 22 for injection into molten metal contained within ladle 24. Station 10 also includes a second magnesium injector 3 having a magnesium supply vessel 13 and a second lime injector 5 having a lime supply vessel 15, each injector 3, 5 feeding material into a second supply pipe 17 through respective outlet orifices 19 and 21. Material from second magnesium injector 3 and second lime injector 5 flows with the aid of pressurized transport gas through second supply pipe 17 to a second lance 23 for injection into the molten metal within ladle 24.

As may be understood, dual lance system 10 requires a pair of magnesium injectors 2, 3 and a pair of lime injectors 4, 5 in order to supply each of the dual injection lances 22, 23 with a controlled amount of a suitably proportioned mixture of magnesium and lime. A similar duplication of reagent injectors is necessary in the case of a single immersion lance having independent, dual exit ports injecting magnesium-lime mixture though each port.

SUMMARY OF THE INVENTION

Therefore, it is an object of the present invention to eliminate the need for a duplicate set of reagent injectors in a dual lance or dual port desulfurization station.

In order to achieve this object, a dual outlet injector is provided in a desulfurization station, whereby reagent from the dual outlet injector may be fed simultaneously to two independent supply pipes respectively corresponding to a pair of lances or pair of lance ports of the desulfurization station. The dual outlet injector may comprise an outlet splitter adapted for attachment to the injector's reagent supply vessel. The outlet splitter may include an attachment flange and a pair of conduit branches extending from the flange, whereby powdered reagent may be simultaneously received into each conduit branch of the splitter from a common outlet of the reagent supply vessel. The splitter may further include a pair of orifice valves, one in each conduit branch, for regulating output flow from the injector to the associated supply pipe carrying reagent to a lance. The splitter may also include a gate or shut-off valve in each conduit branch at a location upstream from the orifice valve for selectively allowing and stopping flow through the associated conduit branch.

The invention extends to a dual lance or dual port desulfurization station comprising a first dual outlet injector having a magnesium supply vessel and a second dual outlet injector having another reagent supply vessel, such as a lime supply vessel. Each injector simultaneously feeds powdered reagent to two different supply pipes, whereby a suitable reagent mixture can be carried to each lance or lance port without the need for a duplicate pair of reagent injectors.

A programmable logic controller may be used to automatically operate the orifice valves of the injectors based on information from sensors and detectors installed in the desulfurization station. In one embodiment, weigh cells associated with the reagent supply vessels and flow sensors associated with the lance supply pipes send signal information to the programmable logic controller for feedback control to achieve and maintain a target mixing ratio and flow rate of reagent mixture to a pair of lances. It is also possible to install pressure sensors in the lance supply pipes and/or the reagent supply vessels for feedback control purposes. Manual operation is also possible.

A diverter system may be installed between the lance supply pipes for diverting all flow to one lance or lance port when the other lance or lance port is malfunctioning or being serviced. The diverter system may be manually operated, and it may be connected to the programmable logic controller for automatic diversion of flow if a problem is sensed.

BRIEF DESCRIPTION OF THE DRAWING FIGURES

The nature and mode of operation of the present invention will now be more fully described in the following detailed description of the invention taken with the accompanying drawing figures, in which.

DETAILED DESCRIPTION OF THE INVENTION

Figure 1:
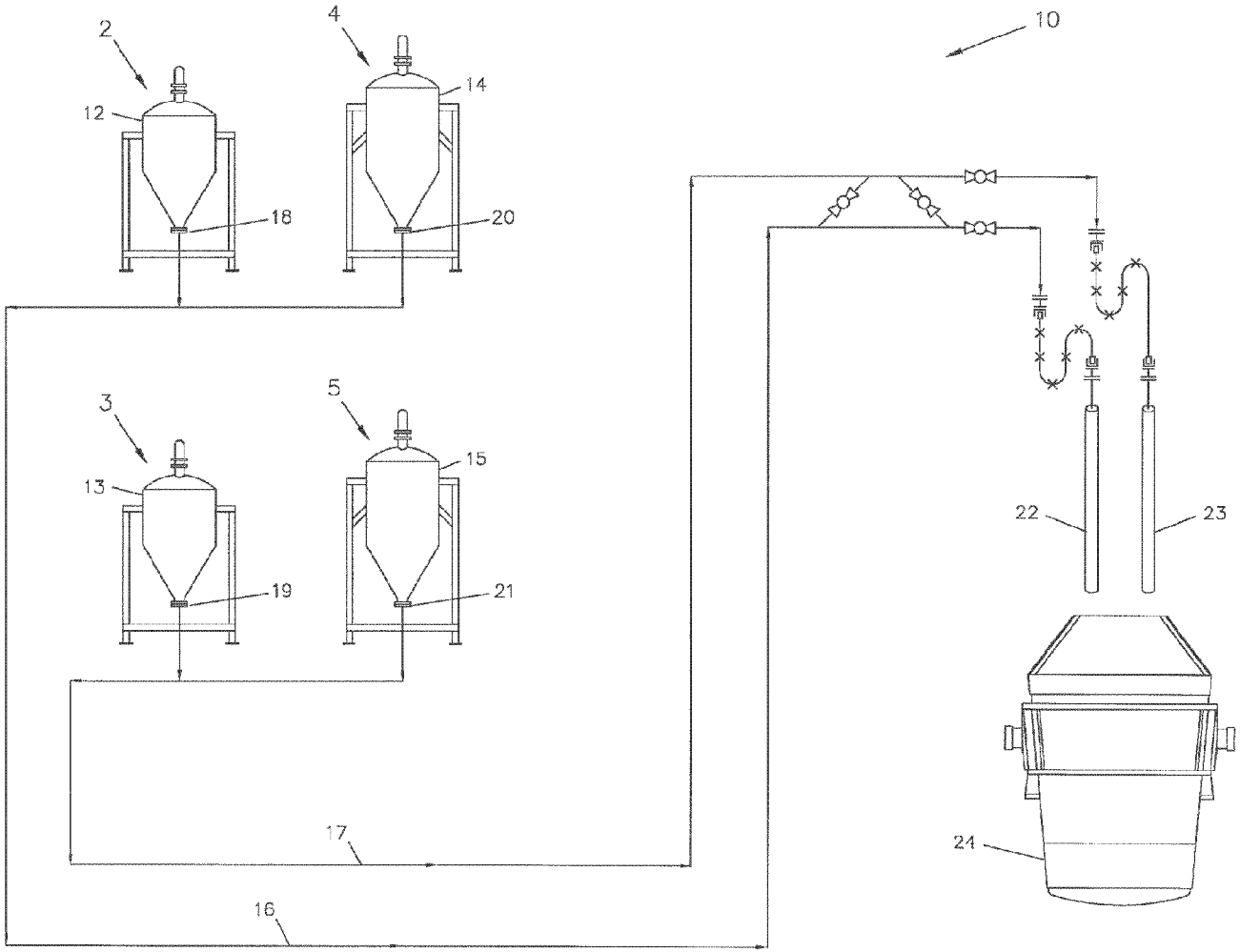
FIG. 1 (PRIOR ART)
FIG. 1 is a schematic diagram of a desulfurization station having a dual lance injection system in accordance with prior art.
Figure 2:
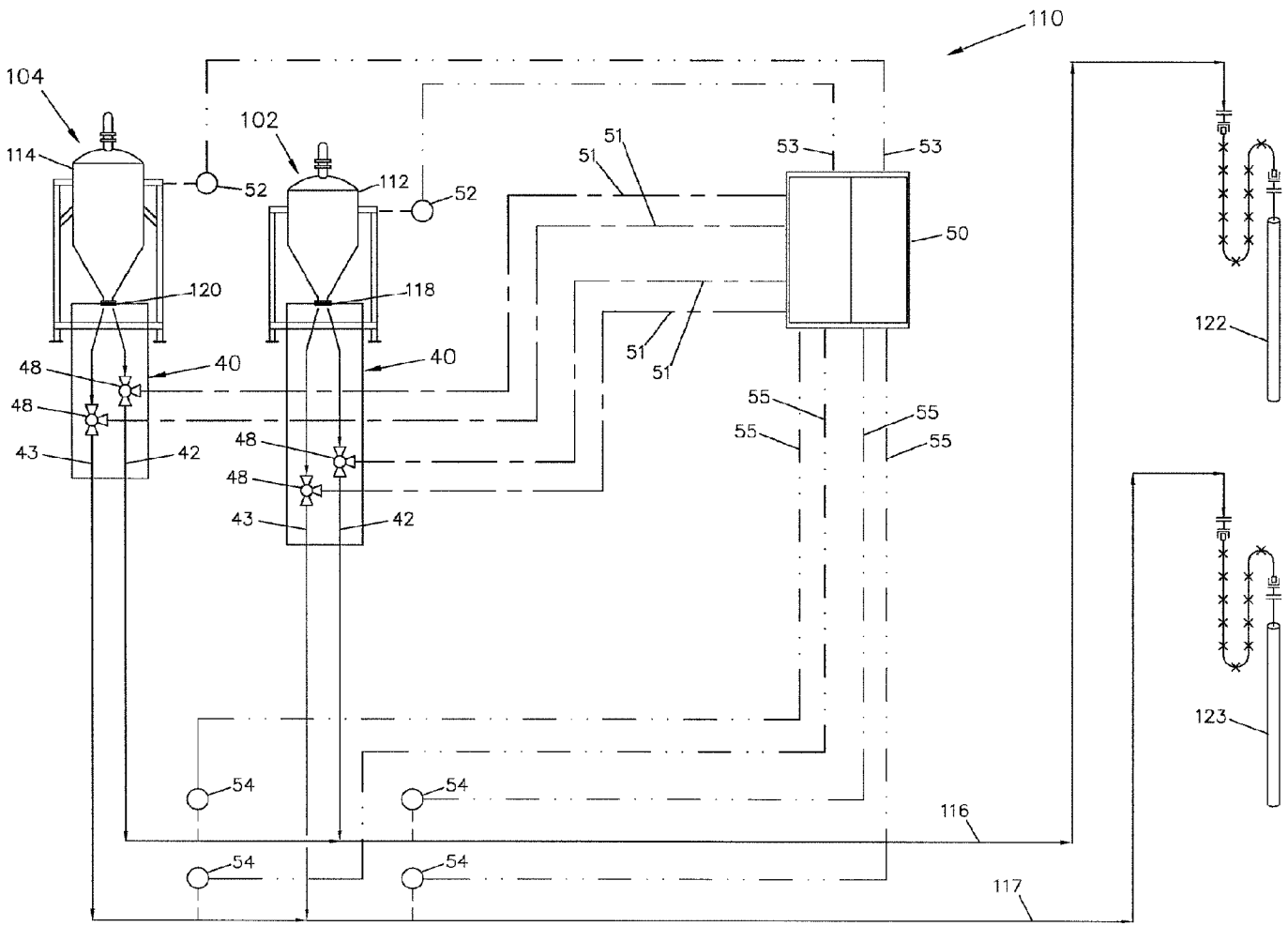
FIG. 2 is a schematic diagram of a desulfurization station having a dual lance injection system operating with a single magnesium injector and a single lime injector, wherein each injector is a dual outlet injector in accordance with an embodiment of the present invention.

Reference is now made to FIG. 2 of the drawings, wherein a desulfurization station formed in accordance with an embodiment of the present invention is identified by reference numeral 110. Desulfurization station 110 comprises a single magnesium injector 102 having a magnesium supply vessel 112 feeding powdered magnesium into a first supply pipe 116 and also into a second supply pipe 117 by way of an outlet splitter 40 attached to magnesium supply vessel 112 to receive powdered magnesium exiting the supply vessel through an outlet orifice 118 at a bottom portion of the vessel. Outlet splitter 40, described in greater detail below, includes a first branch 42 connected to first supply pipe 116 and a second branch 43 connected to second supply pipe 117, and is operable to inject powdered magnesium from vessel 112 into both supply pipes 116 and 117. Supply pipes may be, for example, ¾ inch pipe (0.75 inch ID, 1.05 inch OD), 1 inch pipe (1.0 inch ID, 1.31 inch OD), or other size pipe suitable for flow communication with lances 122, 123.

Likewise, desulfurization station 110 further comprises a single lime injector 104 having a lime supply vessel 114 feeding powdered lime into first supply pipe 116 and into second supply pipe 117 by way of another outlet splitter 40 attached to lime supply vessel 114 in association with an outlet orifice 120 of lime supply vessel 114. As will be understood, lime is a carrier reagent in the example embodiments described herein, and another carrier reagent may be substituted for lime without straying from the invention.

Powdered magnesium from injector 102 and powdered lime from injector 104 flows through first supply pipe 116 to a first lance 122 for injection into molten metal contained within a transfer ladle (not shown). In similar fashion, powdered magnesium from injector 102 and powdered lime from injector 104 flows through second supply pipe 117 to a second lance 123 for injection into molten metal contained within the transfer ladle (not shown).

Figure 3:
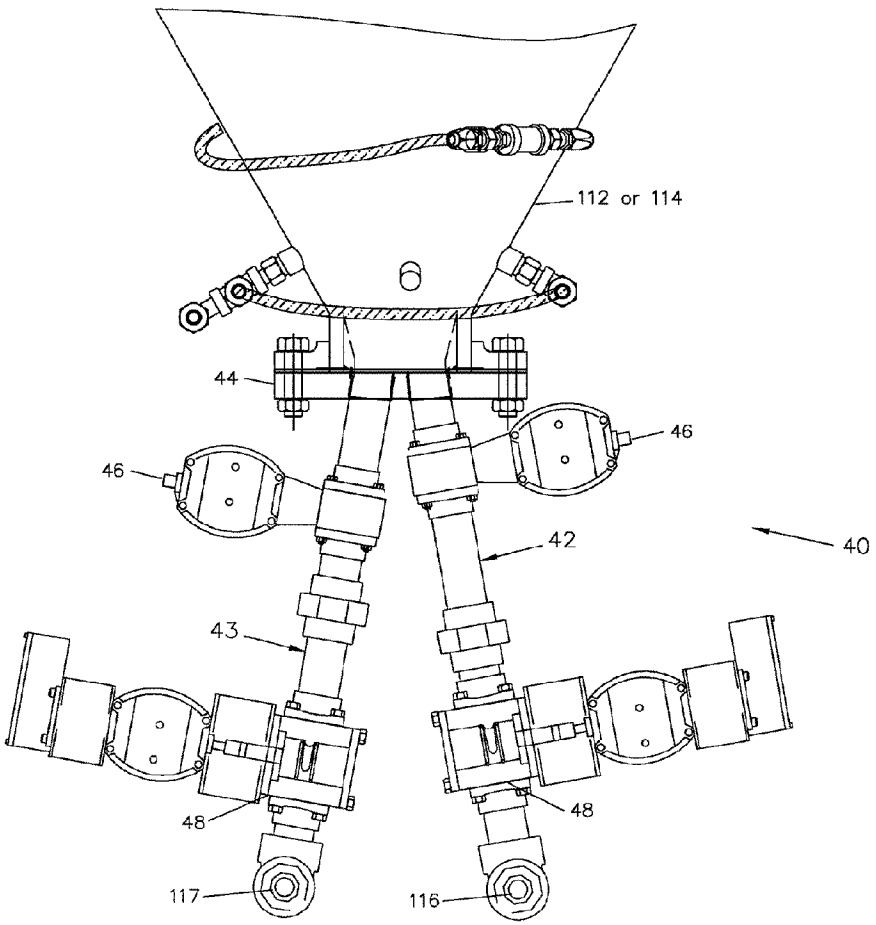
FIG. 3 shows an outlet splitter attached to the respective reagent supply vessel of each dual outlet injector in the system of FIG. 2.

Outlet splitter 40, shown in greater detail in FIG. 3, is designed for attachment to a reagent supply vessel, such as magnesium supply vessel 112 or lime supply vessel 114. Splitter 40 may include a flange 44 adapted for attachment to the outlet portion of the supply vessel, for example by providing a bolt-hole circle about the flange or by configuring the flange to cooperate with other attachment devices. Splitter 40 may be removably attached to the supply vessel, for example by threaded fasteners or other suitable means, or permanently attached to the supply vessel, for example by welding. For typical applications, a six-inch diameter ANSI standard-class 300# flange may be used. As mentioned above, splitter 40 includes first branch 42 and second branch 43. Branches 42 and 43 are each in communication with the vessel outlet orifice and may diverge slightly from one another as they extend downward from flange 44. Each branch 42, 43 defines a passageway for carrying powdered reagent out of the vessel to a different associated supply pipe 116, 117. By way of example, branches 42, 43 may comprise 1½ inch pipe (1.5 inch ID, 1.9 inch OD). In the embodiment shown in FIG. 3, each branch 42, 43 includes a gate valve 46 operable to shut-off or open flow from the vessel to the branch, and an orifice valve 48 located downstream from gate valve 46. Gate valve may be a suitable commercially available valve, such as a 1½ inch Worcester ball valve, product #1 ½-4446TSE. Orifice valve 48 may be a fixed orifice valve, in which case flow rates may be varied by varying the pressure in the vessel, or by changing the orifice. Alternatively, orifice valve 48 may be a variable orifice valve having an adjustable orifice, for example a variable orifice valve of the type disclosed in U.S. Pat. No. 5,108,075.

In the context of providing an outlet splitter 40 on each of the magnesium and lime supply vessels, several alternative orifice valve configurations are contemplated. These include four fixed orifice valves (two on the branches of the lime injector's splitter and two on the branches of the magnesium injector's splitter); four variable orifice valves (two on the branches of the lime injector's splitter and two on the branches of the magnesium injector's splitter); two fixed orifice valves on the branches of the lime injector's splitter and two variable orifice valves on the branches of the magnesium injector's splitter; or two fixed orifice valves on the branches of the magnesium injector's splitter and two variable orifice valves on the branches of the lime injector's splitter.

As may be appreciated, dual outlet injectors 102 and 104 enable desulfurization station 110 to operate with exactly one magnesium injector and exactly one lime injector. Consequently, a second magnesium injector and a second lime injector required in desulfurization stations of the prior art may be eliminated or used to provide another independent desulfurization station.

In another aspect of the present invention, desulfurization station 110 may comprise a programmable logic controller (PLC) 50 that sends control signals to orifice valves 48 (in this case variable orifice valves) via lines 51 to automatically achieve and maintain desired flow rates of the respective reagents and a desired mixing ratio thereof. PLC 50 receives a plurality of input signals as feedback. The input signals may include respective weight signals from weigh cells 52 associated with supply vessels 112 and 114 communicated to PLC 50 by way of lines 53, wherein the weight signals indicate the weight of reagent remaining in each vessel. The input signals may include respective flow rate signals from flow sensors 54 positioned along supply pipes 116 and 117 communicated to PLC 50 via lines 55. In the embodiment shown in FIG. 2, flow sensors 54 are located along each supply pipe 116, 117 between the injection point of lime from injector 104 and the injection point of magnesium from injector 102 and also after (downstream from) the injection point of magnesium from injector 102. PLC 50 may be programmed to send control signals to orifice valves 48 based on the input signals the PLC receives from weigh cells 52 and flow sensors 54 to continually adjust injection of reagent into supply lines 116 and 117 to achieve and maintain targeted reagent flow rates and a targeted mixing ratio for the reagent mixture delivered to lances 122 and 123. As mentioned above, pressure sensors may be installed to provide additional feedback signals to PLC 50. Of course, desulfurization station 110 may be manually controlled by overriding or omitting PLC 50.

Figure 4:
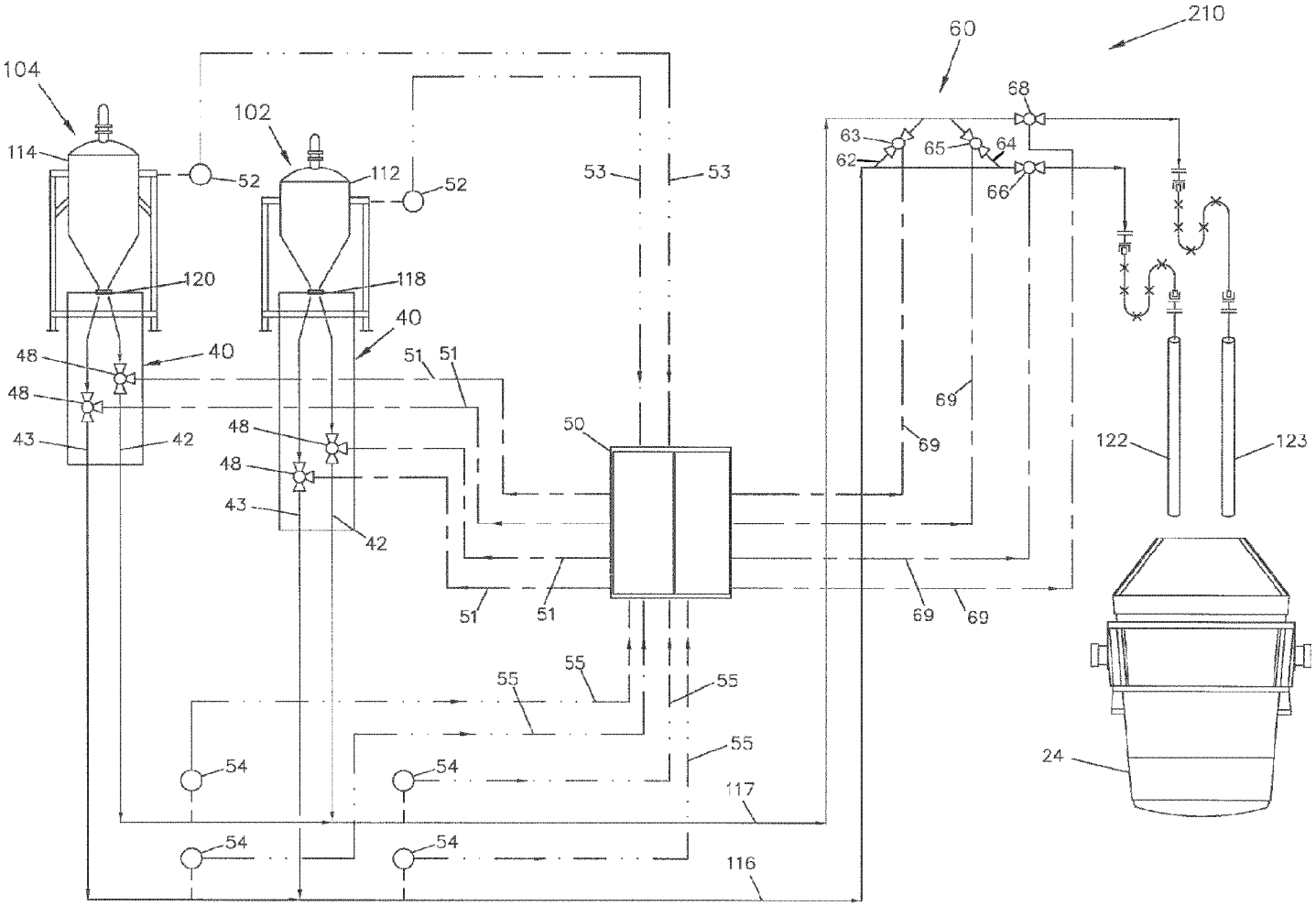
FIG. 4 is a schematic diagram of a desulfurization station having a dual lance injection system in accordance with another embodiment of the present invention.

FIG. 4 shows a desulfurization station 210 formed in accordance with another embodiment of the present invention. Station 210 is generally similar to station 110 of FIG. 2, however a lance diverter system 60 is provided between supply pipes 116 and 117 for diverting some or all of the reagent flow from one supply pipe to the other, whereby only one of the dual lances 122, 123 injects to ladle 24 while the other lance is serviced. Lance diverter system 60 includes a crossover pipe 62 from supply pipe 116 to supply pipe 117, and another crossover pipe 64 from supply pipe 117 to supply pipe 116. Flow through crossover pipe 62 is restricted by an associated valve 63, and flow through crossover pipe 64 is restricted by an associated valve 65. A shut-off valve 66 is located downstream from crossover pipe 62 along supply pipe 116 for selectively stopping flow to lance 122, in which case flow from supply pipe 116 may be diverted to supply pipe 117 for injection by lance 123. Similarly, a shut-off valve 68 is located downstream from crossover pipe 64 along supply pipe 117 for selectively stopping flow to lance 123, in which case flow from supply pipe 117 may be diverted to supply pipe 116 for injection by lance 122. Valves 63, 65, 66, and 68 may be connected to PLC 50 by lines 69 for automatic diversion of flow to one of the lances if a flow problem is detected with respect to the other lance. Of course, the valves of lance diverter system 60 may be manually operated to divert flow if a problem is observed or detected.

While a preferred form of this invention has been described above and shown in the accompanying drawings, it should be understood that applicant does not intend to be limited to the particular details described above and illustrated in the accompanying drawings. Thus, it is the desire of the inventors of the present invention that it be clearly understood that the embodiments of the invention, while preferred, can be readily changed and altered by one skilled in the art and that these embodiments are not to be limiting or constraining on the form or benefits of the invention.

What is claimed is:

1. A dual outlet injector for use in a desulfurization station, the injector comprising:

a reagent supply vessel having at least one outlet orifice through which reagent stored in the vessel passes;

an outlet splitter mounted on the reagent supply vessel, the outlet splitter including a pair of conduit branches, wherein each conduit branch conducts a portion of the reagent passed through the at least one outlet orifice; and at least one valve associated with each of the pair of conduit branches for controlling flow of reagent through the associated conduit branch.

2. The injector of claim 1, wherein the outlet splitter is removably mounted on the reagent supply vessel.

3. The injector of claim 1, wherein the outlet splitter is permanently mounted on the reagent supply vessel.

4. The injector of claim 1, wherein the pair of conduit branches diverge from one another as they extend away from the at least one outlet orifice.

5. The injector of claim 1, wherein the at least one valve includes an orifice valve for regulating flow of reagent through the associated conduit branch.

6. The injector of claim 5, wherein the orifice valve is a fixed orifice valve.

7. The injector of claim 5, wherein the orifice valve is a variable orifice valve.

8. The injector of claim 7, further comprising a programmable logic controller arranged to generate and send control signals to the variable orifice valve to regulate reagent flow.

9. The injector of claim 8, further comprising a weigh cell arranged to generate a weight signal representing the weight of reagent remaining in the reagent supply vessel, the programmable logic controller receiving the weight signal, wherein the control signals generated by the programmable logic controller are based at least in part on the weight signal.

10. The injector of claim 8, further comprising at least one flow sensor arranged downstream from each of the pair of conduit branches, each flow sensor generating a respective flow rate signal, the programmable logic controller receiving the flow rate signal, wherein the control signals generated by the programmable logic controller are based at least in part on the flow rate signal.

11. The injector of claim 5, wherein the at least one valve further includes a gate valve between the at least one outlet orifice of the reagent supply vessel and the orifice valve for selectively shutting off and opening flow of reagent through the associated conduit branch.

12. A desulfurization station comprising:

a first dual outlet injector including exactly one first reagent supply vessel and a first outlet splitter mounted on the first reagent supply vessel at an outlet orifice of the first reagent supply vessel, the first outlet splitter having a pair of conduit branches;

a first supply pipe connected to a first branch of the pair of conduit branches of the first outlet splitter and a second supply pipe connected to the second branch of the pair of conduit branches of the first outlet splitter;

a second dual outlet injector including exactly one second reagent supply vessel and a second outlet splitter mounted on the second reagent supply vessel at an outlet orifice of the second reagent supply vessel, the second outlet splitter having a pair of conduit branches;

the first supply pipe being connected to a first branch of the pair of conduit branches of the second outlet splitter and the second supply pipe being connected to a second branch of the pair of conduit branches of the second outlet splitter; and at least one injection lance in communication with the first supply pipe and the second supply pipe; wherein the first and second dual outlet injectors simultaneously inject reagent from the first reagent supply vessel and the second reagent supply vessel, respectively, into the first and second supply pipes.

13. The desulfurization station of claim 12, wherein the at least one injection lance is a dual port injection lance having a first port in communication with the first supply pipe and a second port in communication with the second supply pipe.

14. The desulfurization station of claim 12, wherein the at least one injection lance includes a first injection lance in communication with the first supply pipe and a second injection lance in communication with the second supply pipe.

15. The desulfurization station of claim 12, wherein the first reagent supply vessel stores powdered magnesium and the second reagent supply vessel stores another reagent.

16. The desulfurization station of claim 12, wherein each conduit branch of the first and second outlet splitters includes an orifice valve.

17. The desulfurization station of claim 16 wherein each conduit branch of the first and second outlet splitters further includes a gate valve.

18. The desulfurization station of claim 16, wherein at least one of the orifice valves is a variable orifice valve.

19. The desulfurization station of claim 18, further comprising a programmable logic controller connected to the at least one variable orifice valve for sending control signals to the at least one variable orifice valve.

20. The desulfurization station of claim 19, further comprising at least one sensor providing a respective feedback signal as input to the programmable logic controller.

21. The desulfurization station of claim 20, wherein the at least one sensor includes a first weigh cell arranged to generate a first weight signal representing the weight of reagent remaining in the first reagent supply vessel and a second weigh cell arranged to generate a second weight signal representing the weight of reagent remaining in the second reagent supply vessel.

22. The desulfurization station of claim 20, wherein the at least one sensor includes at least one flow sensor arranged in the first supply pipe and at least one flow sensor arranged in the second supply pipe, each flow sensor generating a respective flow rate signal.

23. The desulfurization station of claim 12, further comprising a lance diverter system between the first and second supply pipes, the lance diverter system including a first crossover pipe for diverting flow from the first supply pipe to the second supply pipe and a second crossover pipe for diverting flow from the second supply pipe to the first supply pipe.

24. The desulfurization station of claim 23, wherein the lance diverter system further includes a valve in each of the first and second crossover pipes, a first shut-off valve in the first supply pipe downstream from the first crossover pipe, and a second shut-off valve in the second supply pipe downstream from the second crossover pipe.

25. The desulfurization station of claim 24, further comprising a programmable logic controller connected to send control signals to the valves in the first and second crossover pipes and to the first and second shut-off valves.

26. A method for desulfurization of molten iron comprising the steps of:

simultaneously injecting a first reagent from a first reagent supply vessel into a first supply pipe and a second supply pipe via an outlet splitter mounted on the first reagent supply vessel; and discharging flow from the first supply pipe and flow from the second supply pipe through at least one injection lance into the molten iron.

27. A method for desulfurization of molten iron comprising the steps of:

simultaneously injecting a first reagent from a first reagent supply vessel into a first supply pipe and a second supply pipe via a first outlet splitter mounted on the first reagent supply vessel;

simultaneously injecting a second reagent from a second reagent supply vessel into the first supply pipe and the second supply pipe via a second outlet splitter mounted on the second reagent supply vessel, wherein the first reagent and the second reagent flow together as a mixture through the first supply pipe and through the second supply pipe; and discharging flow from the first supply pipe and flow from the second supply pipe through at least one injection lance into the molten iron.

28. The method of claim 27, wherein the at least one injection lance is a dual port injection lance having a first port in communication with the first supply pipe and a second port in communication with the second supply pipe.

29. The method of claim 27, wherein the at least one injection lance includes a first injection lance in communication with the first supply pipe and a second injection lance in communication with the second supply pipe.

30. The method of claim 27, wherein the first reagent includes powdered magnesium and the second reagent is another reagent.

31. The method of claim 30, wherein the another reagent includes powdered lime.

32. The method of claim 30, wherein the another reagent includes calcium carbide.

* * * * *

UNITED STATES PATENT AND TRADEMARK OFFICE

CERTIFICATE OF CORRECTION

PATENT NO. : 8,623,270 B2
APPLICATION NO. : 13/001497
DATED : January 7, 2014
INVENTOR(S) : Waitlevertch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 268 days.

Signed and Sealed this
Twenty-second Day of September, 2015

Michelle K. Lee

Michelle K. Lee
*Director of the United States Patent and Trademark Office*